United States Patent [19]

Gottschall

[11] Patent Number: 4,501,028

[45] Date of Patent: Feb. 26, 1985

[54] LIGHTWEIGHT REFLECTIVE BELT

[76] Inventor: George T. Gottschall, 2020 E. 22nd St., Fremont, Nebr. 68025

[21] Appl. No.: 497,861

[22] Filed: May 25, 1983

[51] Int. Cl.[3] ..... A41F 3/02

[52] U.S. Cl. ..... 2/338

[58] Field of Search ..... 2/338, 300, 321, 322

[56] References Cited

U.S. PATENT DOCUMENTS 1,071,594 8/1913 Smith ..... 2/338

3,086,529 4/1963 Munz et al. ..... 2/322

FOREIGN PATENT DOCUMENTS 2732792 2/1979 Netherlands ..... 2/338

*Primary Examiner*—Doris L. Troutman

*Attorney, Agent, or Firm*—Zarley, McKee, Thomte, Voorhees & Sease

[57] ABSTRACT

A lightweight reflective belt for runners and the like has inner and outer layers of a thin supple material secured together with a center layer of a soft spongy material sandwiched therebetween to impart body to the layered belt. Coacting fasteners are provided on the opposite ends of the belt for length-adjustably securing the opposite ends together. The outer layer of the belt has a bright reflective surface to substantially increase the wearer's visibility when the belt is worn loosely on the wearer's hips.

8 Claims, 5 Drawing Figures

LIGHTWEIGHT REFLECTIVE BELT

BACKGROUND OF THE INVENTION

The present invention relates generally to a reflective belt for increasing a wearer's visibility to vehicular traffic and the like and more particularly to a length-adjustable belt of a lightweight supple material having a bright reflective outer surface whereby the belt may be worn loosely on one's hips in a comfortable non-binding fashion.

Reflective belts generally have been known and used for years for increasing one's visibility. School patrol boys, for example, have long worn heavy canvas waist belts having a slanted over-the-shoulder extension to present a bright warning to motorists. Such belts are relatively stiff and would be unacceptable for general wear because of the resulting discomfort. Such belts would be unacceptable for runners because of their weight and binding effect. Such belts would also block the sun for those runners wishing to suntan while running.

Reflective headbands have been provided for runners but these are difficult to see because of their small size and because the wearer's head is generally higher than the aim of vehicle headlights. Other belts have been provided with hard protruding reflectors which are heavy and possibly dangerous if fallen upon.

Accordingly, a primary object of the invention is to provide an improved lightweight reflective belt.

Another object is to provide a lightweight reflective belt adapted to lie loosely on the wearer's hips for minimal interference with body movements.

Another object is to provide a lightweight reflective belt which is length-adjustable to accommodate various individuals and to be used over various types of clothing on any one individual.

Another object is to provide a reflective belt of a thin supple material but with sufficient body to maintain its shape for presenting a reflective surface of maximum size.

Another object is to provide a lightweight reflective belt with the capability of carrying small objects in a pocket thereof and providing identification information for the wearer.

Another object is to provide a lightweight reflective belt which is durable in construction, economical to manufacture and efficient in operation.

SUMMARY OF THE INVENTION

The lightweight reflective belt of the present invention includes inner and outer layers of a thin supple material and a center layer of a soft spongy material for imparting body to the belt member. Coacting fasteners are provided on the opposite ends of the belt member for length-adjustably securing the ends together. The outer layer of the belt has a bright reflective surface for increased visibility of the wearer, both during the day and at night.

Because the belt is made of a very lightweight supple material, it causes no interference with the wearer's movements when worn loosely on the wearer's hips. This is particularly attractive for runners for whom lightweight non-binding clothing is essential. The belt can be made of sufficient width to provide substantial visibility to approaching motorists. When worn on one's hips, it does not interfere with suntanning one's upper body.

Such a belt finds ready application for runners who often prefer the paved surface of streets but the belt is also readily adaptable for use by bicyclists, motorcyclists, roller skaters, skateboarders, mechanics working on vehicles along the roadsides and pedestrians generally. The hip-riding belt will not affect the wearer's hairdo as would a headband, for example, and the lightweight nature of the belt makes it readily compressible for storage in one's purse or pocket when not in use. A pocket and identification tag accessories are useful for carrying small objects such as a key and for identifying the wearer and providing important medical information in the event of an accident.

DESCRIPTION OF THE PREFERRED EMBODIMENT

Figure 1:
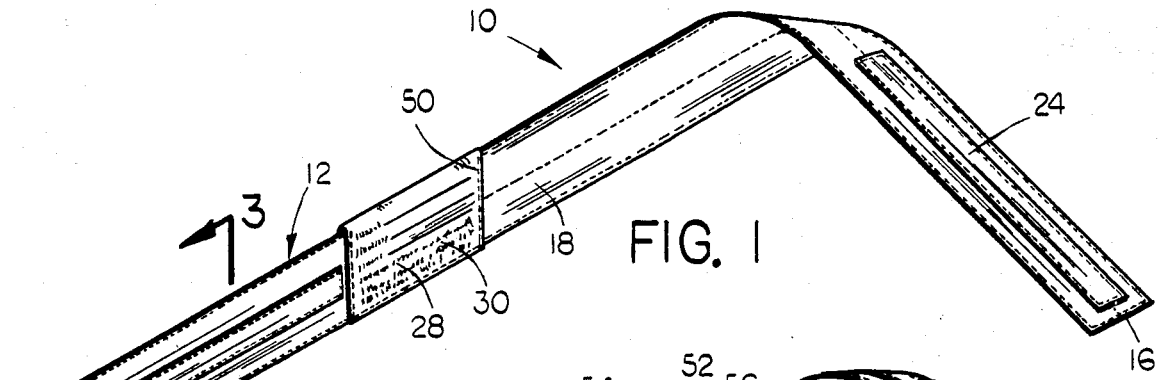
FIG. 1 is a perspective view of the belt showing the identification tag and end fasteners thereon.
Figure 2:
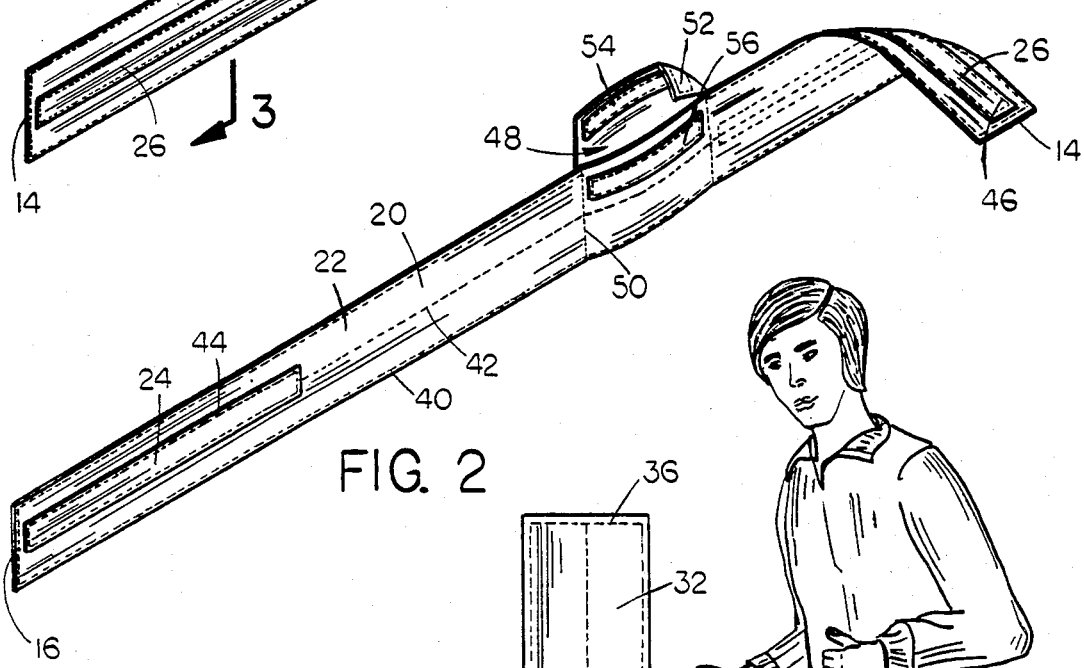
FIG. 2 is another perspective view of the belt showing the pocket thereof.

The lightweight reflective belt 10 of the present invention is shown in FIGS. 1 and 2 as including an elongated belt member 12 having opposite ends 14 and 16 and inner and outer layers 18 and 20 of a thin supple material. The outer layer 20 has a bright reflective surface which is readily visible to vehicular traffic when the belt is worn loosely on the wearer's hips.

Coacting fasteners 24 and 26 are provided on the opposite ends 14 and 16 of the belt for length-adjustably securing the ends together. Coacting hook and latch strips 24 and 26 of Velcro type fasteners are preferred because of their lightweight and supple construction. The belt may be provided with a pocket 28 and an identification tag 30 as shown in FIG. 1.

Figure 3:
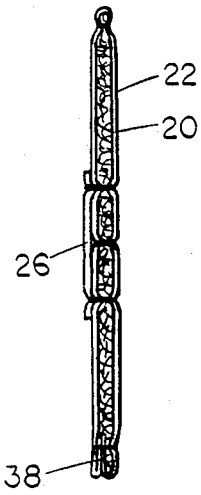
FIG. 3 is an enlarged sectional view as seen on line 3—3 in FIG. 1.
Figure 5:
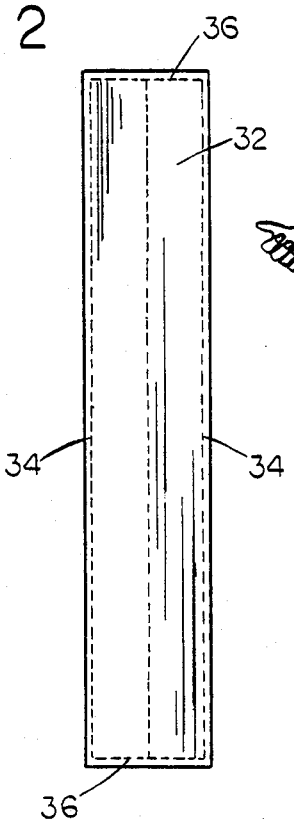
FIG. 5 is a plan view of the fabric blank from which the belt is made.

The construction of the belt is shown and described with reference to FIGS. 3 and 5. The belt starts with an elongated blank 32 of a lightweight supple material such as nylon. Suitable dimensions are 7 inches wide by 44 inches long. The dotted lines 34 and 36 indicate fold lines and are preferably positioned approximately ½ inch from the outer edges of the blank 32. The ends and both edges are folded inward to form half inch hems as indicated at 38 in FIG. 3. Thus the effective width of the blank is reduced to 6 inches. It is then folded in half again along its longitudinal centerline to a final width of 3 inches with the folded halves of the blank forming the inner and outer layers 18 and 20. A layer of soft spongy fiber fill of polyester, for example, is then inserted in sandwiched relation between the inner and outer layers whereupon the belt is stitched along the edges and down the center as indicated at 40 and 42, respectively, in FIG. 2. The Velcro fasteners 24 and 26 are then placed on opposite sides and opposite ends of the belt member and sewn in place by stitching 44 and 46 around the peripheral edges thereof.

Finally, the pocket 28 is then formed by positioning a piece of fabric 48 on one surface of the belt so that it extends above one edge as shown in FIG. 2 and then stitching the fabric 48 in place along the bottom and two sides thereof as indicated at 50. The top extension 52 may be folded over the opposite side of the belt to form a closure flap. Coacting fasteners such as Velcro strips 54 and 56 may be provided on the closure flap 52 and pocket front as shown in FIG. 2. The backside of the pocket fabric may be provided with lines on which the wearer's name, address, phone number and pertinent medical information may be written with a permanent laundry marking pen, for example, so that the recorded information will stand to repeated washings of the belt.

Such a belt formed of a bright reflective nylon material may weigh only 1 to 2 ounces. Whereas the invention is not limited to any particular color for the nylon material, a brilliant striking eye-catching hunter's orange color is preferred since it is very effective for use both during the day and at night. Other bright reflective colors could alternately be used, as preferred. The nylon material is referred to as "supple" in the sense that it easily bends and twists without resistance, as distinguished from a more rigid fabric such as denim. The shape of the belt is maintained by the center fiber fill layer which imparts body to the belt.

Figure 4:
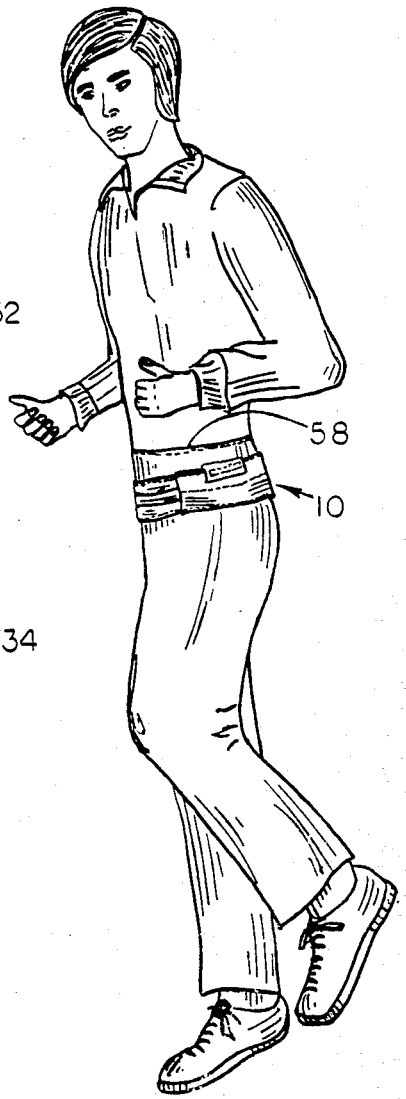
FIG. 4 is a perspective view of a runner wearing the reflective belt.

It is preferred that the belt be adjusted to a length greater than the wearer's waist measurement and less than the wearer's hip measurement so that the belt rests loosely on the wearer's hips as shown in FIG. 4. In such position, the belt is non-binding and free of interference with walking or running movements of the wearer. Its large exposed surface is situated approximately at the level of vehicle headlights so as to be readily visible to provide the extra second of warning that may be necessary to avoid potential accident situations.

In FIG. 4, the numeral 58 designates the waistband of the runner's trousers and coincides in height with the runner's waist.

The invention additionally contemplates an improved method of increasing a person's visibility to vehicular traffic by providing a length-adjustable belt of a lightweight supple material having a bright reflective outer surface, wrapping the belt around one's midsection and adjusting the length to rest loosely on the wearer's hips.

Thus there has been shown and described a lightweight reflective belt which accomplishes at least all of the stated objects.

I claim:

1. A lightweight reflective belt, comprising, an elongated belt member having opposite ends and inner and outer layers of a thin supple material, a center layer of a soft spongy material, and means for securing said inner, outer and center layers together whereby said center layer imparts body to the layered belt member, said means for securing said inner, outer and central layers together comprising multiple spaced-apart lengths of stitching for a quilted effect, coacting fastener means on the opposite ends of the belt member and operative for length adjustably securing said opposite ends together, said outer layer having a bright reflective surface over substantially the entire outer layer whereby, upon securement of the opposite ends so that the belt member loosely rests on a wearer's hips, the visibility of the wearer is increased.

2. The reflective belt of claim 1 wherein said inner and outer layers comprise folded halves of a single piece of material.

3. The reflective belt of claim 1 wherein the bright reflective surface of the outer layer has a width of at least approximately three inches.

4. The reflective belt of claim 1 wherein said reflective surface has a fluorescent color.

5. The reflective belt of claim 1 wherein said coacting fastener means comprises VELCRO type fasteners.

6. The reflective belt of claim 1 further comprising an identification tag and means for permanently affixing said identification tag to said inner or outer layer.

7. The reflective belt of claim 1 further comprising a pocket formed along said belt member and including a closure flap and means for releasably securing said flap in a closed position.

8. The reflective belt of claim 7 wherein said pocket comprises a piece of material secured to one of said inner and outer layer along the bottom and two sides thereof, said material extending above said belt member to form said closure flap.

* * * * *